US007053749B2

(12) United States Patent
Ishida et al.

(10) Patent No.: US 7,053,749 B2
(45) Date of Patent: May 30, 2006

(54) METAL PLATE RESISTOR

(75) Inventors: Kazuhiro Ishida, Ina (JP); Satoshi Chiku, Ina (JP)

(73) Assignee: KOA Corporation, Nagano (JP)

( * ) Notice: Subject to any disclaimer, the term of this patent is extended or adjusted under 35 U.S.C. 154(b) by 0 days.

(21) Appl. No.: 11/132,303

(22) Filed: May 19, 2005

(65) Prior Publication Data

US 2005/0258930 A1 Nov. 24, 2005

(30) Foreign Application Priority Data

May 20, 2004 (JP) ..... 2004-150562
Feb. 22, 2005 (JP) ..... 2005-045697

(51) Int. Cl.
*H01C 1/14* (2006.01)

(52) U.S. Cl. ..... 338/324; 338/323; 338/328; 338/333

(58) Field of Classification Search ..... 338/206, 338/208, 324, 327, 328, 330, 332, 333, 309, 338/322, 323
See application file for complete search history.

(56) References Cited

U.S. PATENT DOCUMENTS 3,506,771 A * 4/1970 Cole, Jr. ..... 373/134
3,654,580 A * 4/1972 Laisi ..... 338/61
4,317,104 A * 2/1982 Bergmann et al. ..... 338/330
4,339,743 A * 7/1982 Ludwig ..... 338/206
4,529,958 A * 7/1985 Person et al. ..... 338/275
4,906,821 A * 3/1990 Bechevet et al. ..... 219/521
5,223,820 A * 6/1993 Sutterlin et al. ..... 340/641
5,287,083 A * 2/1994 Person et al. ..... 338/332
5,469,131 A * 11/1995 Takahashi et al. ..... 338/306
6,139,130 A * 10/2000 Takahashi et al. ..... 347/62
6,148,502 A * 11/2000 Gerber et al. ..... 29/621
6,392,528 B1 * 5/2002 Myong ..... 338/22 R
6,441,718 B1 * 8/2002 Smejkal et al. ..... 338/329
6,489,881 B1 * 12/2002 Aleksandravicius et al. ..... 338/307
2003/0201870 A1 * 10/2003 Ikemoto et al. ..... 338/206

FOREIGN PATENT DOCUMENTS

JP 58-168160 11/1983
JP 63-124701 8/1988
JP 3-73465 7/1991
JP 5-82002 11/1993
JP 2000-232009 8/2000
JP 2001-118701 4/2001

* cited by examiner

*Primary Examiner*—Tu Hoang
(74) *Attorney, Agent, or Firm*—Westerman, Hattori, Daniels & Adrian, LLP.

(57) ABSTRACT

A metal plate resistor includes a resistive body comprising a metal plate, and at least a pair of electrodes joined respectively to opposite ends of the resistive body, the electrodes being made of a highly conductive metal conductor. The resistive body has a main section positioned between the electrodes and a pair of electrode sections progressively wider than the main section in directions away from the main section. The electrodes are disposed respectively beneath the electrode sections and identical in shape to the electrode sections.

5 Claims, 8 Drawing Sheets

RESULTS OF POWER CYCLE TEST ON H-SHAPED RESISTOR

RESULTS OF POWER CYCLE TEST ON I-SHAPED RESISTOR

RESULTS OF HEAT CYCLE TEST ON H-SHAPED RESISTOR

RESULTS OF HEAT CYCLE TEST ON I-SHAPED RESISTOR

METAL PLATE RESISTOR

BACKGROUND OF THE INVENTION

1. Field of the Invention

The present invention relates to a metal plate resistor suitable for use in current detecting applications or the like.

2. Description of the Related Art

Heretofore, metal plate resistors having a resistive body in the form of a metal plate with electrodes attached to its respective opposite ends have widely been used as current detecting resistors or the like. Known metal plate resistors are made of a copper-nickel alloy, a nichrome alloy, an iron-chromium alloy, a manganin alloy, or the like, and has a low resistance of several mΩ or lower. For details, reference should be made to Japanese laid-open patent publication No. 2002-184601.

Some metal plate resistors for use in harsh environments at high temperatures, such as in automobiles, are mounted on aluminum mounting boards that have a good heat radiating capability and are of a relatively low cost. Since an aluminum mounting board and a metal plate resistor mounted thereon have largely different coefficients of thermal expansion, the soldered joint between the aluminum mounting board and the metal plate resistor tends to be deteriorated soon due to thermal fatigue. Therefore, there has been a demand in the art for a metal plate resistor which is highly reliable against thermal fatigue of the soldered joint between the metal plate resistor and an aluminum mounting board on which it is used, and which is sufficiently reliable even when it is mounted on an aluminum mounting board.

SUMMARY OF THE INVENTION

It is therefore an object of the present invention to provide a metal plate resistor which is of a small-size compact structure, and which is highly stable against aging and environmental changes due to mechanical, thermal, and electrical stresses after it is mounted on a mounting board such as an aluminum mounting board even though the difference of coefficients of thermal expansion between the mounting board and the metal plate resistor exists.

To achieve the above object, there is provided in accordance with the present invention a metal plate resistor comprising a resistive body comprising a metal plate, and at least a pair of electrodes joined respectively to opposite ends of the resistive body, the electrodes being made of a highly conductive metal conductor, wherein width of the resistive body which is positioned between the electrodes is narrower than width of the resistive body which is positioned on the electrodes.

The resistive body may be of an H shape as viewed in plan and includes a pair of wider portions of the resistive body at electrode sections, and the electrodes are joined respectively to the wider portions of the resistive body. The electrodes may be identical in shape to the wider portions of the resistive body.

According to the present invention, there is also provided a metal plate resistor comprising a resistive body of a metal plate, and at least a pair of electrodes joined respectively to opposite ends of the resistive body, the electrodes being made of a highly conductive metal conductor, wherein the resistive body comprises a main section positioned between the electrodes and a pair of electrode sections progressively wider than the main section in directions away from the main section, and the electrodes are disposed respectively beneath the resistive body at the electrode sections and identical in shape to the resistive body at the electrode sections.

The electrode sections may be progressively wider than the main section at an angle ranging from 30° to 90°, or preferably at an angle of 45°. The electrodes may have a thickness of at least 150 μm. The electrodes may have an octagonal shape as viewed in plan.

According to the present invention, there is further provided a metal plate resistor comprising a resistive body comprising a metal plate, at least a pair of electrodes joined respectively to opposite ends of the resistive body, the electrodes being made of a highly conductive metal conductor, wherein the resistive body comprises a main section and a pair of electrode sections progressively wider than the main section in directions away from the main section, each of the electrode sections being of an octagonal shape as viewed in plan, and having an upper surface lying flush with an upper surface of the main section and a lower surface projecting downwardly beyond a lower surface of the main section, and the electrodes are of an octagonal shape as viewed in plan which is identical to the electrode sections and are joined respectively to the lower surfaces of the electrode sections, a protective coating providing an integral covering on the upper surface of the main section, portions of the upper surfaces of the electrode sections, the lower surface of the main section, and side surfaces of the main section, and a plated coating providing an integral covering on lower surfaces of the electrodes, side surfaces of the electrodes, side surfaces of the electrode sections, and portions of the upper surfaces of the electrode sections which are not covered with the protective coating.

With the arrangement of the present invention, the electrodes of the metal plate resistor that are joined to a mounting board have a shape as viewed in plan which is wider than conventional I-shaped resistors. The wider electrodes are effective to reduce a current density therein. When the metal plate resistor is mounted on an aluminum board as the mounting board by soldered joints, then thermal stresses developed in the soldered joints are distributed around the beneath of all over the electrodes. Thus, the soldered joints are subject to less thermal fatigue in areas where thermal stresses are concentrated on the soldered joints between the metal plate resistor and the mounting board. Accordingly, even if the metal plate resistor is mounted on the aluminum board whose coefficient of linear expansion is widely different from that of the metal plate resistor, the metal plate resistor is highly stable against aging and environmental changes due to mechanical, thermal, and electrical stresses.

The octagonal electrode sections that are progressively wider than the main section in the directions away from the main section are effective to distribute areas in which thermal stresses are concentrated in the soldered joints in a power cycle test, primarily at inner slanted sides of the octagonal electrode sections, and also to distribute areas in which thermal stresses are concentrated in the soldered joints in a heat cycle test, primarily at outer slanted sides of the octagonal electrode sections. As a result, a thermal cycle test conducted on the metal plate resistor mounted on the aluminum board can produce good reliability test results. Accordingly, the metal plate resistor can be mounted on the aluminum board whose coefficient of linear expansion is widely different from that of the metal plate resistor without causing any significant problems.

The above and other objects, features, and advantages of the present invention will become apparent from the following description when taken in conjunction with the accompanying drawings, which illustrate a preferred embodiment of the present invention by way of example.

DETAILED DESCRIPTION OF THE PREFERRED EMBODIMENTS

Figure 1A:
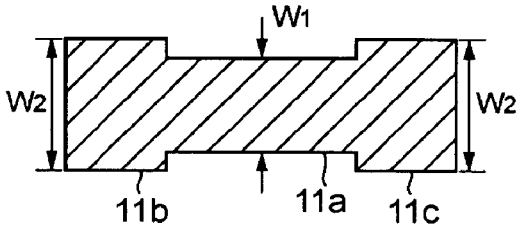
FIG. 1A is a plan view of a metal plate resistor according to a first embodiment of the present invention.
Figure 1B:
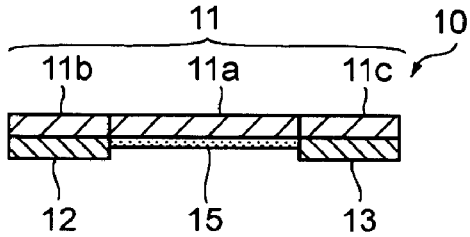
FIG. 1B is a vertical cross-sectional view of the metal plate resistor according to the first embodiment.
Figure 1C:
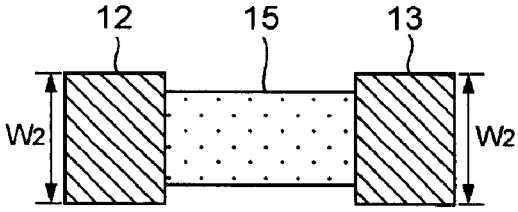
FIG. 1C is a bottom view of the metal plate resistor according to the first embodiment.

Like or corresponding parts are denoted by like or corresponding reference characters throughout views, and will not repetitively be described.

FIGS. 1A through 1E show a metal plate resistor 10 according to a first embodiment of the present invention. The metal plate resistor 10 comprises a resistive body 11 in the form of a metal plate, a pair of electrodes 12, 13 in the form of thin plates of Cu (highly conductive metal conductor) joined respectively to the lower surfaces of opposite ends 11*b*, 11*c* of the resistive body 11. The resistive body 11 is made of a Cu—Ni alloy, a Ni—Cr alloy, a Fe—Cr alloy, a Pd—Pt alloy, an Au—Ag alloy, an Au—Pt—Ag alloy, or the like. The electrodes 12, 13 have molten solder layers or plated coating layers provided on their respective surfaces for allowing the electrodes 12, 13 to be easily soldered to a land pattern on a mounting board when the metal plate resistor 10 is mounted on the mounting board. An insulating layer 15 is disposed on the bottom surface of the resistive body 11 between the electrodes 12, 13 in covering relation to the bottom or reverse surface of the resistive body 11.

The metal plate resistor 10 has a low resistance of about 1 mΩ, and has a power capacity of several watts. The metal plate resistor 10 has a high resistance accuracy within ±1% and a low temperature coefficient of resistance (TCR) of 75 ppm/° C. or lower. The metal plate resistor 10 is preferably mounted on power supply circuit boards in various electronic devices, and used for current detecting purposes.

The resistive body 11 is of an H shape as viewed in plan, and has a narrow central section (main section) 11*a* between the opposite ends (electrode sections) 11*b*, 11*c*. Specifically, the central section (main section) 11*a* of the resistive body 11 has a smaller width W1 than the width W2 of the opposite ends 11*b*, 11*c*, (i.e., electrode sections 11*b*, 11*c*,) of the resistive body 11. Stated otherwise, the electrode sections 11*b*, 11*c* have their width W2 greater than the width W1 of the central section (main section) 11*a*. The electrodes 12, 13 are of a rectangular shape that is substantially identical to the resistive body of electrode sections 11*b*, 11*c*.

Figure 1D:
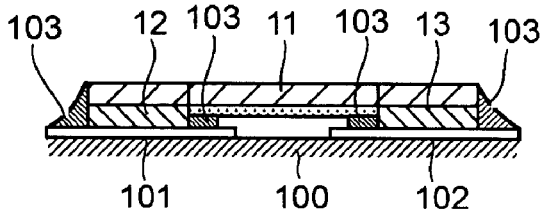
FIG. 1D is a vertical cross-sectional view of the metal plate resistor according to the first embodiment as mounted on a mounting board.

FIG. 1D shows the metal plate resistor 10 as mounted on a mounting board 100, which comprises an aluminum board having a good heat radiating capability, for example. The aluminum board 100 has land patterns 101, 102, and the bottom and side surfaces of the electrodes 12, 13 are joined to the land patterns 101, 102 by solder joints(fillets) 103. A current flowing through the resistive body 11 is supplied through the land patterns 101, 102, and heat generated by the resistive body 11 is conducted through the electrodes 12, 13 to the aluminum board 100.

Figure 1E:
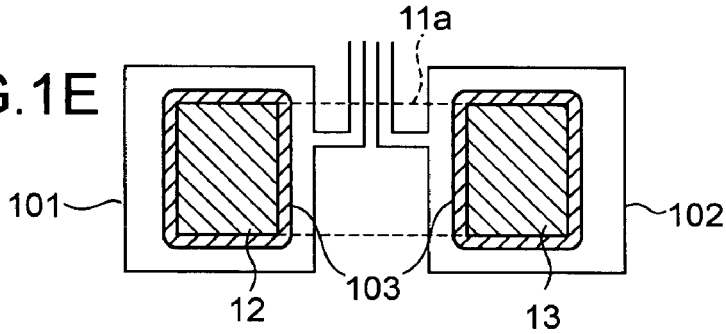
FIG. 1E is a plan view of the metal plate resistor around the electrodes according to the first embodiment as mounted on a mounting board.

As shown in FIG. 1E, electrodes 12, 13 are firmly joined to the land patterns 101, 102 by not only the solders between the bottom surface of electrodes and surface of the land pattern but also the solder fillets 103, which surrounds the electrodes 12, 13 on all around the side surfaces thereof.

Figure 2A:
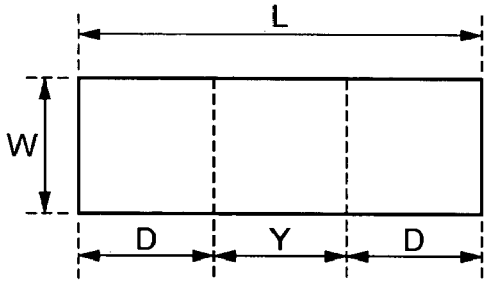
FIG. 2A is a plan view of a conventional metal plate resistor according to a comparative example.
Figure 2B:
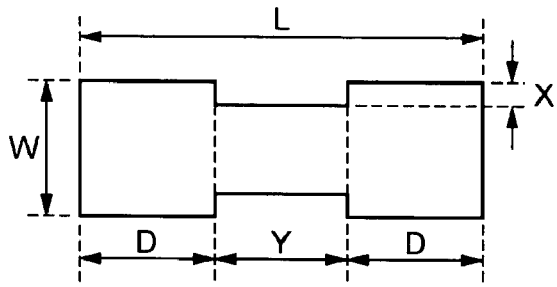
FIG. 2B is a plan view of a metal plate resistor according to an inventive example.

FIG. 2A shows an example of dimensions of a conventional metal plate resistor according to a comparative example, which was used in a test described below, and FIG. 2B shows an example of dimensions of a metal plate resistor according to an inventive example which was used in the test. The conventional metal plate resistor has a straight I shape as viewed in plan, and the metal plate resistor according to the inventive example has an H shape as viewed in plan including a narrower central section (main section) and wider opposite ends. The test was conducted on the metal plate resistors mounted on aluminum boards. In the test, a high power current (corresponding to 10 W) passing through each of the metal plate resistors was turned on for 10 seconds and turned off for 10 seconds in one cycle, and 50,000 such cycles were carried out on the metal plate resistors.

After the 50,000 cycles finished, each of the metal plate resistors was checked for measuring changes in their resistances. The change in the resistance of the conventional metal plate resistor was about 3%, whereas the change in the resistance of the metal plate resistor according to the inventive example was about 0.1% or less. Resistors in the form of metal plates suffer extremely small characteristic changes of resistive bodies themselves in a high current application (power) cycle test. Therefore, characteristic changes of metal plate resistors due to usage over a long period of time appear to be caused chiefly by a change in the soldered joint between the metal plate resistor and the mounting board. The above result of the test indicates that the metal plate resistor according to the present invention is effective to prevent cracking due to thermal fatigue in the soldered joint, and is kept stable in operation.

Figure 3A:
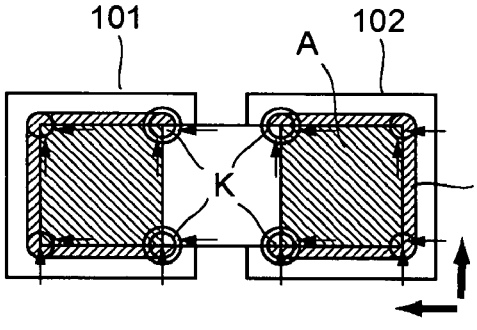
FIG. 3A is a bottom view of the conventional metal plate resistor according to the comparative example as mounted on a mounting board.

The mechanism of the prevention of cracking will be described below with reference to FIGS. 3A and 3B. FIG. 3A is a bottom view of the conventional metal plate resistor shown in FIG. 2A as mounted on a mounting board by soldered joints. The arrows in FIG. 3A indicate the directions in which the mounting board tends to expand. The directions in which the mounting board tends to expand vary depending on the position on the mounting board and the environment in which the metal plate resistor is used. Hatched areas represent soldered joints A and solder fillets B between the electrodes of the metal plate resistor and the mounting board. Stresses applied by transverse and longitudinal expansion of the mounting board concentrate on corner areas indicated by a circle beneath the electrodes, and the soldered joints appear to start cracking from those areas. Particularly, areas K indicated by a dual-line circle suffer concentrated stresses and currents, and are easily heated and liable to start cracking.

Figure 3B:
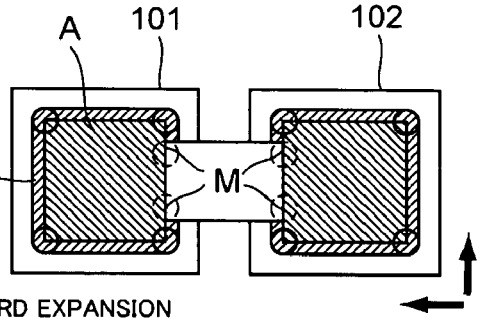
FIG. 3B is a bottom view of the metal plate resistor according to the inventive example as mounted on a mounting board.

FIG. 3B is a bottom view of the metal plate resistor according to the inventive example shown in FIG. 2B as mounted on a mounting board by soldered joints. Though stresses applied by transverse and longitudinal expansion of the mounting board concentrate on corner areas indicated by a circle beneath the electrodes, stresses due to concentrated currents are distributed to areas M indicated by a circle. Consequently, cracking in the soldered joints is reduced in inner corner areas K beneath the electrodes.

Figure 4A:
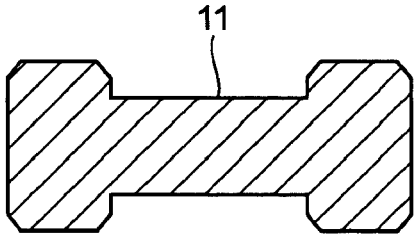
FIG. 4A is a plan view of a metal plate resistor according to a second embodiment of the present invention.
Figure 4B:
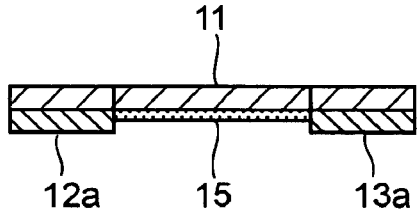
FIG. 4B is a vertical cross-sectional view of the metal plate resistor according to the second embodiment.
Figure 4C:
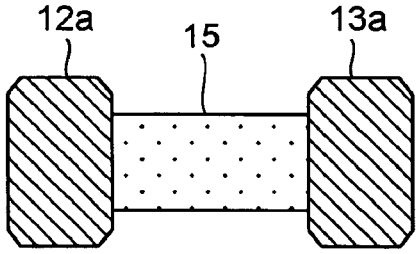
FIG. 4C is a bottom view of the metal plate resistor according to the second embodiment.

FIGS. 4A through 4C show a metal plate resistor according to a second embodiment of the present invention. The metal plate resistor according to the second embodiment is essentially the same as the metal plate resistor according to the first embodiment shown in FIGS. 1A through 1D, but differs therefrom as to the shape of the corners of electrodes 12*a*, 13*a*. Specifically, the electrodes 12*a*, 13*a* have a substantially rectangular shape as viewed in plan, with beveled corners. The beveled corners are effective to reduce stresses that would tend to be concentrated in the soldered joints beneath the corners of the rectangular electrodes. Consequently, the soldered joints are further prevented from suffering cracking, making the metal plate resistor highly reliable in operation.

Figure 5A:
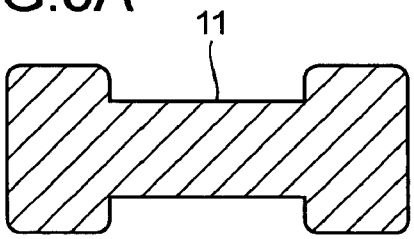
FIG. 5A is a plan view of a metal plate resistor according to a third embodiment of the present invention.
Figure 5B:
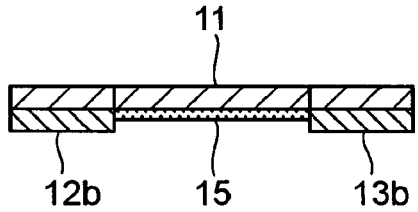
FIG. 5B is a vertical cross-sectional view of the metal plate resistor according to the third embodiment.
Figure 5C:
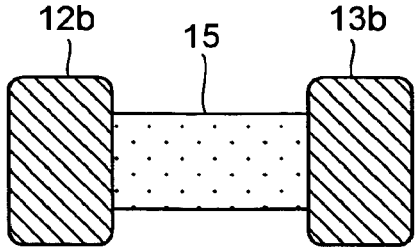
FIG. 5C is a bottom view of the metal plate resistor according to the third embodiment.

FIGS. 5A through 5C show a metal plate resistor according to a third embodiment of the present invention. The metal plate resistor according to the third embodiment is also essentially the same as the metal plate resistor according to the first embodiment shown in FIGS. 1A through ID, but differs therefrom as to the shape of the corners of electrodes 12*b*, 13*b*. Specifically, the electrodes 12*b*, 13*b* have a substantially rectangular shape as viewed in plan, with curved (round) corners. The curved (round) corners are also effective to reduce stresses that would tend to be concentrated in the soldered joints beneath the corners of the rectangular electrodes. Consequently, the soldered joints are further prevented from suffering cracking, making the metal plate resistor highly reliable in operation.

Figure 6A:
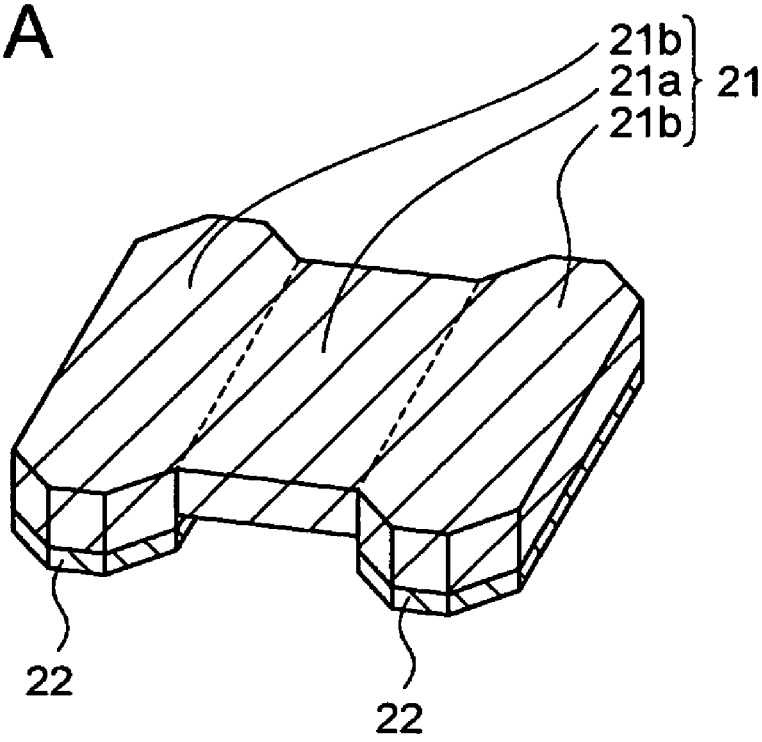
FIG. 6A is a perspective view of a metal plate resistor according to a fourth embodiment of the present invention.
Figure 6B:
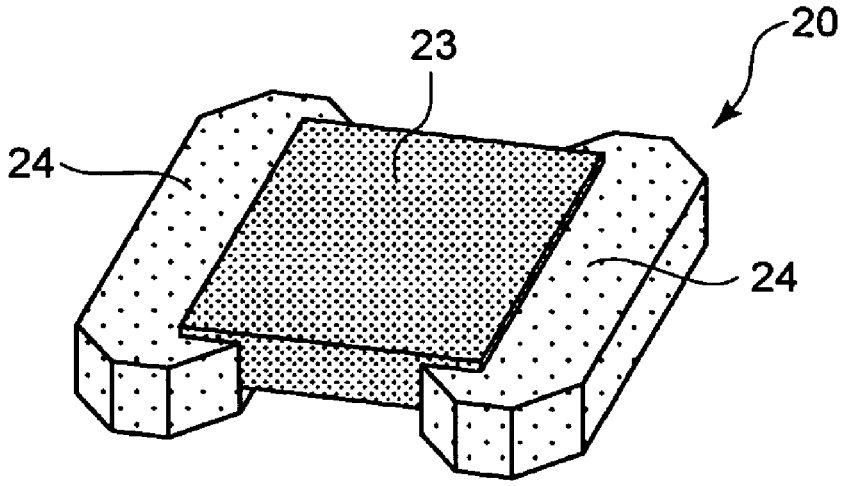
FIG. 6B is a perspective view of the metal plate resistor according to the fourth embodiment as it is finished into a complete product.

FIGS. 6A and 6B show in perspective a metal plate resistor 20 according to a fourth embodiment of the present invention. FIG. 6A shows a resistive body and electrodes of the metal plate resistor, and FIG. 6B shows the metal plate resistor as it is finished into a complete product with a protective coating on the resistive body and a plated coating on the electrodes. As shown in FIG. 6A, the metal plate resistor 20 comprises a resistive body 21 in the form of a metal plate (resistive alloy plate) made of a copper-nickel alloy, a nickel-chromium alloy, or the like, and a pair of electrodes 22 made of copper (highly conductive metal conductor) joined respectively to the lower surfaces of opposite ends of the resistive body 21.

The resistive body 21 has an H shape or butterfly shape as viewed in plan comprising a main section 21*a* positioned between the electrodes 22, 22 and a pair of electrode sections 21*b*, 21*b* including portions progressively wider than the main section 21*a* in directions away from the main section 21*a*. The electrodes 22 are disposed beneath the resistive body of the respective electrode sections 21*b* and are identical in shape to the resistive body of the electrode sections 21*b*. The electrodes 22 and the resistive body of the electrode sections 21*b* are octagonal in shape as viewed in plan.

Specifically, each of the electrode sections 21*b* has an inner slanted portion progressively wider than the main section 21*a* in a direction away from the main section 21*a*, an intermediate parallel portion next to the inner slanted portion, and an outer slanted portion progressively narrower than the intermediate parallel portion toward an end in the longitudinal direction of the metal plate resistor 20. The resistive body of the electrode sections 21*b* has upper surfaces lying flush with the upper surface of the resistive body of the main section 21*a* and lower surfaces projecting downwardly beyond the lower surface of the main section 21*a*. The octagonal copper electrodes 22 are joined to the lower surfaces of the resistive body of the respective electrode sections 21*b*.

As shown in FIG. 6B, when the metal plate resistor 20 is finished into a complete product, the resistive body of the main section 21*a* is covered with a protective coating 23 comprising an insulative resin layer. The protective coating 23 has portions extending onto and covering the resistive body of the electrode sections 21*b*. Specifically, the protective coating 23 provides an integral covering on the upper surface of the resistive body of the main section 21*a*, portions of the upper surfaces of the resistive body of the electrode sections 21*b*, the lower surface of the resistive body of the main section 21*a*, and the side surfaces of the resistive body of the main section 21*a*. The electrodes 22 and portions of the resistive body of the electrode sections 21*b*, which are not covered with the protective coating 23, are covered with a plated coating 24 comprising a nicked-plated base layer and a plated layer of tin or tin alloy formed thereon. Specifically, the plated coating 24 provides an integral covering on the lower surfaces of the electrodes 22, the side surfaces of the electrodes 22, the side surfaces of the resistive body of the electrode sections 21*b*, and the portions of the upper surfaces of the resistive body of the electrode sections 21*b* which are not covered with the protective coating 23.

Figure 7A:
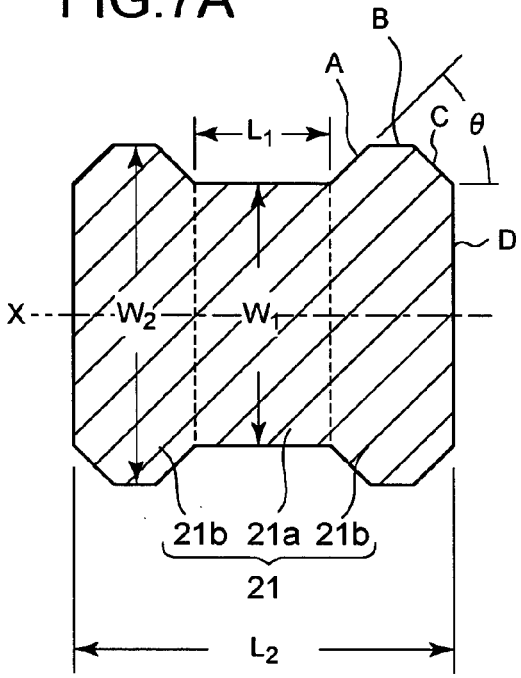
FIG. 7A is a plan view of the metal plate resistor shown in FIG. 6A.
Figure 7B:
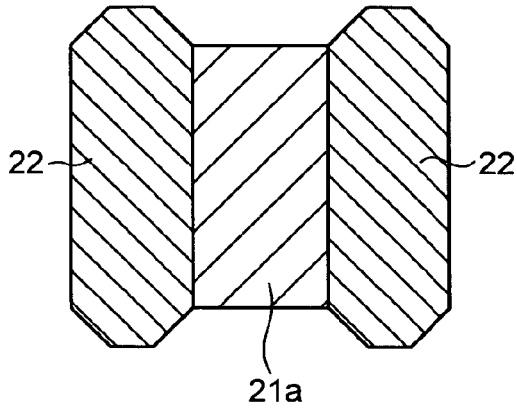
FIG. 7B is a bottom view of the metal plate resistor shown in FIG. 6A.
Figure 7C:
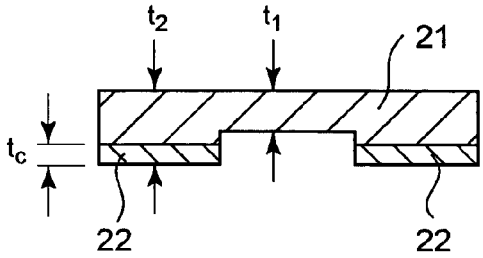
FIG. 7C is a cross-sectional view taken along line X of FIG. 7A.
Figure 7D:
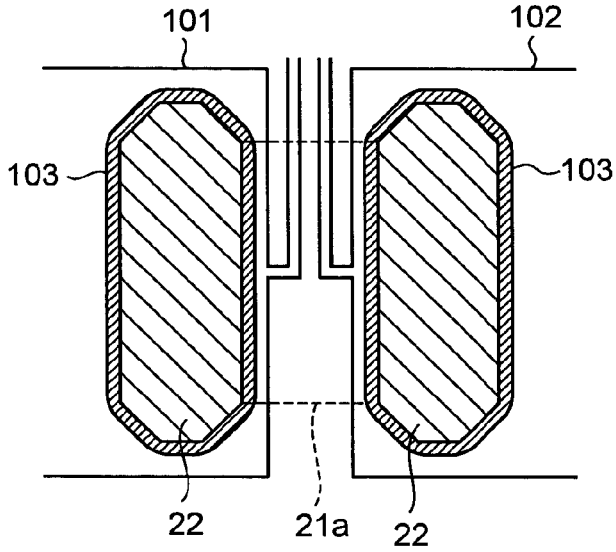
FIG. 7D is a plan view of the metal plate resistor shown in FIG. 6B, as mounted on a mounting board.

When the metal plate resistor 20 is mounted on a mounting board, solder fillets 103 are formed on the all side surfaces of the octagonal electrodes 22 and the resistive body of the electrode sections 21*b*, firmly joining the metal plate resistor 20 to land patterns 101, 102 on the mounting board as shown in FIG. 7D. Specifically, when the metal plate resistor 20 is mounted on the mounting board, the octagonal structure of the resistive body of the electrode sections 21*b* and the electrodes 22 provide an increased area on their side surfaces, and hence the solder fillets 103 on the side surfaces of the resistive body of the electrode sections 21*b* and the electrodes 22 are provided in an increased area, allowing the metal plate resistor 20 to be firmly mounted on the mounting board with increased bonding strength. The protective coating 23 provides a wide area on the upper surface of the resistive body 21, extending to the electrode sections 21*b*, so that a large and flat surface for markings is available on the upper surface of the resistive body 21. Also, the large and flat surface of the protective coating 21 on the resistive body 21 is available for better resistor mounting operation.

Since the octagonal structure of the resistive body of the electrode sections 21*b* and the electrodes 22 has wider width than the width of the main(center) section 21*a*, and has no sharp electrode corners, it can distribute stresses that would be developed in the soldered joints due to the different coefficients of thermal expansion of the metal plate resistor and the aluminum board beneath the electrode corners. Particularly, the inner slanted portions of the electrode sections 21*b*, which are progressively wider than the main sections 21*a*, are effective to distribute stresses in a power cycle test, and the outer slanted portions of the electrode sections 21*b*, which are progressively narrower than the intermediate parallel portion, are effective to distribute stresses in a heat cycle test.

Structural details of the metal plate resistor 20 according to the fourth embodiment shown in FIGS. 6A and 6B will be described below with reference to FIGS. 7A through 7C. The metal plate resistor 20 shown in FIGS. 7A through 7C has a resistance of around 1 mΩ, and is of a thin flat chip structure having an overall length $L_2$ of 10 mm, a width $W_2$ of 8.4 mm, and a thickness $t_2$ of 0.65 mm. The metal plate resistor 20 has its resistance essentially determined depending on the dimensions of the main section 21*a* positioned between the opposite ends thereof and the specific resistance of the material of the resistive body 21. The main section 21*a* has a length $L_1$ of 4 mm, a width $W_1$ of 6.4 mm, and a thickness $t_1$ of 0.35 mm. The resistive body 21 is made of, for example, a copper-nickel alloy having a resistivity of 49 μΩ·cm to give the metal plate resistor 20 the resistance of 1 mΩ, as described above.

The length $L_1$ of the resistive body 21 may be reduced to ¾ of 4 mm, i.e., 3 mm, and the other dimensions and the resistivity of the resistive body 21 may remain unchanged, so that the metal plate resistor 20 may have a resistance of 0.75 mΩ. Alternatively, the dimensions of the resistive body 21, the length $L_1$ being 4 mm or 3 mm, may remain unchanged and the resistive body 21 may be made of a material having a resistivity that is twice the above value of 49 μΩ·cm, so that metal plate resistor 20 may have a resistance of 1.5 mΩ or 2 mΩ.

The electrodes 22 are made of a highly conductive metal conductor of copper. Each of the electrodes 22 is of an elongate octagonal shape as viewed in plan, which is identical to the shape of the electrode sections 21*b*. Each of the electrodes 22 has a thickness $t_c$ of 200 μm, for example. The thickness $t_c$ of the electrodes 22 is important in keeping the accuracy of the resistance of precision resistors, as described later. The resistive body of the electrode sections 21*b* has a thickness of about 400 μm. Therefore, the total thickness of the electrodes 22 and the resistive body of the electrode sections 21*b* is about 650 μm. The metal plate electrode 20 can thus be used as a precision current detecting resistor which has a low precise resistance value of around 1 mΩ and a rated power ranging from 5 W to 8 W and has a good temperature coefficient of resistance (TCR) of 75 ppm/° C. or less. Since the metal plate electrode 20 is not trimmed and has a straight current path, it is of the non-induction (low inductance) type and has a very low inductance.

Structural features of the metal plate resistor 20 will be described below. As described above, the resistive body 21 is constructed of the main section 21*a* positioned between the electrodes 22 and the octagonal electrode sections 21*b* progressively wider than the main section 21*a* in the directions away from the main section 2 1*a*. The octagonal electrodes 22 of copper which are identical in shape to the electrode sections 21*b* are joined to the resistive body of the electrode sections 21*b* immediately therebeneath. In the present embodiment, each of the electrode sections 21*b* has the inner slanted portion progressively wider than the main section 21*a* in a direction away from the main section 21*a*, i.e., having sides A extending at an angle θ of 45° to the longitudinal axis of the metal plate resistor 20, the intermediate parallel portion having sides B parallel to the side surfaces or sides of the main section 21*a*, and the outer slanted portion progressively narrower than the intermediate parallel portion toward the end, i.e., the side D, i.e., having sides C extending at an angle θ of 45° to the longitudinal axis of the metal plate resistor 20. Thus, the electrode sections 21*b* are of an octagonal shape wider than the main section 21*a*. The sides A, B, C are substantially identical in length to each other.

While the angle θ of the sides A to the longitudinal axis of the metal plate resistor 20 is 45° in the illustrated embodiment, the angle θ may be in the range from 30° to 90°. If the angle θ is too large, nearly a right angle, then stresses are liable to be concentrated in the soldered joints at areas immediately beneath the electrode corners. If the angle θ is too small, stresses are likely to be concentrated in the soldered joints at the corners K (see FIG. 3A) as with the conventional I-shaped resistor shown in FIG. 3A, causing the soldered joints to suffer thermal fatigue.

As shown in FIG. 7D, octagonal electrodes 22, 22 are firmly joined to the land patterns 101, 102 by not only the solders between the bottom surface of electrodes and surface of the land pattern but also the solder fillets 103, which surrounds the octagonal electrodes 22, 22 on all around the side surfaces thereof.

When the mounting board comprises an aluminum board, then its coefficient of linear expansion is about 27 ppm/° C. The coefficient of linear expansion of the resistive body of the metal plate resistor is in the range from 14.9 to 16.5 ppm/° C. for a Cu—Ni alloy, in the range from 13 to 13.5 ppm/° C. for a Ni—Cr alloy, and about 16.5 ppm/° C. for pure copper. Therefore, when the metal plate resistor and the aluminum board suffer the same temperature change, then the aluminum board expands or contracts at a rate which is about twice the rate at which the metal plate resistor expands or contracts. The relatively soft soldered joints between the metal plate resistor and the mounting board undergo repetitive cycles of applied and removed thermal stresses in a thermal cycle test.

When the soldered joints undergo repetitive cycles of applied and removed thermal stresses, the soldered joints suffer thermal fatigue and develop minute cracks, which tend to locally increase the resistance of the cracked regions. As the thermal fatigue goes on, the minute cracks develop into larger cracks, finally causing the soldered joints to peel off.

The thermal cycle test includes a power cycle test in which a current load is applied repetitively intermittently to the metal plate resistor. In the power cycle test, the main section of the resistive body is heated to a highest temperature when the current load is applied, and the heat generated by the main section is transmitted from the electrode sections to the mounting board. Particularly, most of the current flowing through the main section flows from the portions of the electrode sections near the interface with the main section into the lower electrodes, and then flows from the lower electrodes through the soldered joints into the land patterns on the mounting board. Therefore, the main section is thermally expanded, posing forces tending to push out the electrodes. The electrodes fixed to the aluminum board which is highly thermally conductive are progressively lower in temperature away from the main section, and are subject to a small temperature rise at the longitudinally opposite ends of the resistor, which are not largely thermally expanded or contracted.

Therefore, the area of the mounting board where much heat is generated, i.e., the area of the mounting board where thermal stresses are significantly or dominantly developed due to different coefficients of linear expansion, is considered to be those areas of the electrodes which are close to the interface with the main section, and the electrodes and the aluminum board are considered to expand and contract around those areas. Though the resistor as a whole is thermally expanded and contracted only slightly, the areas of the electrodes, which are close to the main section are considered to be thermally expanded or contracted more than the surrounding areas. In the power cycle test, the rectangular electrodes are considered to suffer thermal stresses concentrated in the soldered joints on the inner corners (indicated by K in FIG. 3A) of the electrodes due to the different coefficients of linear expansion. Since the inner slanted sides A progressively wider from the main section are positioned in the areas where the stresses are concentrated on the electrode sections, the stresses can be distributed, reducing the thermal fatigue of the soldered joints.

The thermal cycle test also includes a heat cycle test in which cycles of high and low temperatures are repeated. In the heat cycle test, since the mounting board as a whole and the metal plate resistor as a whole undergo a uniform temperature, the mounting board as a whole and the metal plate resistor as a whole are uniformly thermally expanded and contracted. A main area where thermal stresses are developed due to different coefficients of linear expansion is considered to be located at the center of the metal plate resistor as viewed in plan, i.e., the center of the main section. The aluminum board and the metal plate resistor is considered to be thermally expanded and contracted around such a main area. In the heat cycle test, therefore, thermal stresses are considered to be concentrated on those areas of the soldered joints beneath the outer corners, as viewed in plan, of the electrode sections, i.e., the corners at the opposite ends in the longitudinal direction of the resistor. Since the outer slanted sides C that are progressively narrower than the intermediate parallel portion toward the longitudinally opposite ends are positioned in those areas where the stresses are concentrated, the stresses can be distributed, reducing the thermal fatigue of the soldered joints.

Specifically, with the metal plate resistor according to the fourth embodiment, the electrode sections 21*b* which are octagonal in shape as viewed in plan that are progressively wider than the main section are effective to distribute stresses which would be concentrated in the soldered joints on the areas beneath the electrode corners of the conventional I-shaped resistor. Specifically, with the conventional I-shaped resistor, thermally stresses due to the different coefficients of thermal expansion of the metal plate resistor and the aluminum board are concentrated in the soldered joints on those areas beneath the inner corners (indicated by the K in FIG. 3A) and the outer corners (indicated by circles in FIG. 3A) of the rectangular electrodes, tending to cause the soldered joints to suffer thermal fatigue, so that good test results cannot be obtained. However, using the electrodes, which are octagonal in shape as viewed in plan, is effective to remove corners of the rectangular electrodes of the conventional I-shaped resistor, thereby distributing stresses and reducing thermal fatigue.

The electrode sections which are octagonal in shape as viewed in plan that are progressively wider than the main section are also effective to distribute a current flowing through the main section uniformly to the wider electrode sections. Therefore, the current distribution is made wider, reducing the current density and the heat transfer density in the power cycle test. Specifically, most of the current that has flowed through the main section flows from the areas of the electrode sections near the main section into the copper electrodes, in which the current flows at a uniform density and flows through the soldered joints into the land patterns on the aluminum board. Consequently, the electrode structure that is progressively wider than the main section reduces the concentration of the current, and lowers the density of the current.

Furthermore, the electrode sections which are octagonal in shape as viewed in plan that are progressively wider than the main section are surrounded by solder fillets on the eight sides. Particularly in the power cycle test, as the electrode sections are expanded and contracted around the inner areas thereof, the solder fillets surrounding the eight sides of the electrode sections which are octagonal in shape as viewed in plan are effective to reduce thermal stresses that are developed in the soldered joints of the electrode sections.

In particular, the slanted sides A (see FIG. 7A) that are progressively wider than the main section are highly effective to distribute thermal stresses, and are considered to play an important role in reducing a rate ΔR of change of the resistance in a power cycle test to be described below, which is a life test based on the intermittent application of a current.

The slanted sides C (see FIG. 7A) that are progressively narrower toward the ends or sides D of the electrode sections 21*b* are also highly effective to distribute thermal stresses, and are considered to play an important role in reducing the rate ΔR of change of the resistance in a heat cycle test to be described below.

Figure 8A:
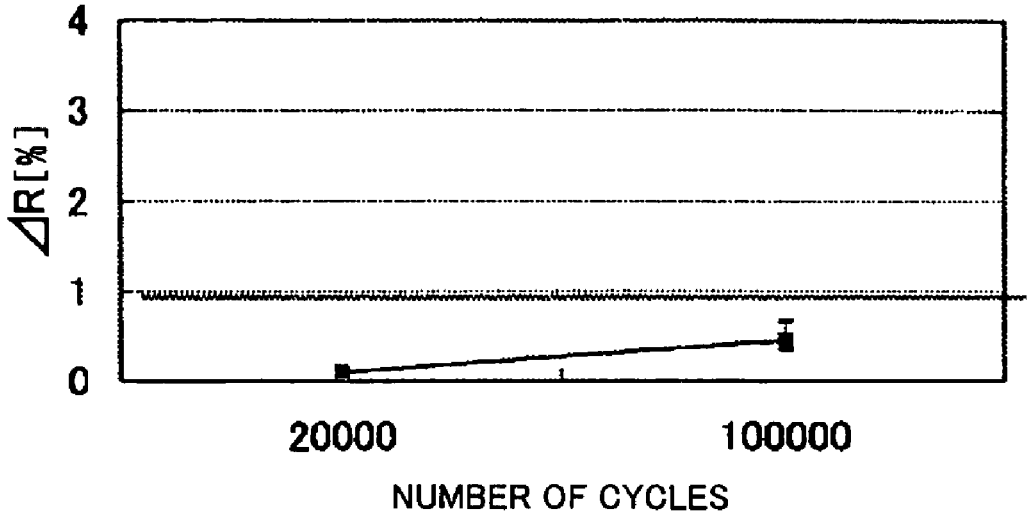
FIG. 8A is a graph showing the results of a power cycle test conducted on an H-shaped resistor.
Figure 8B:
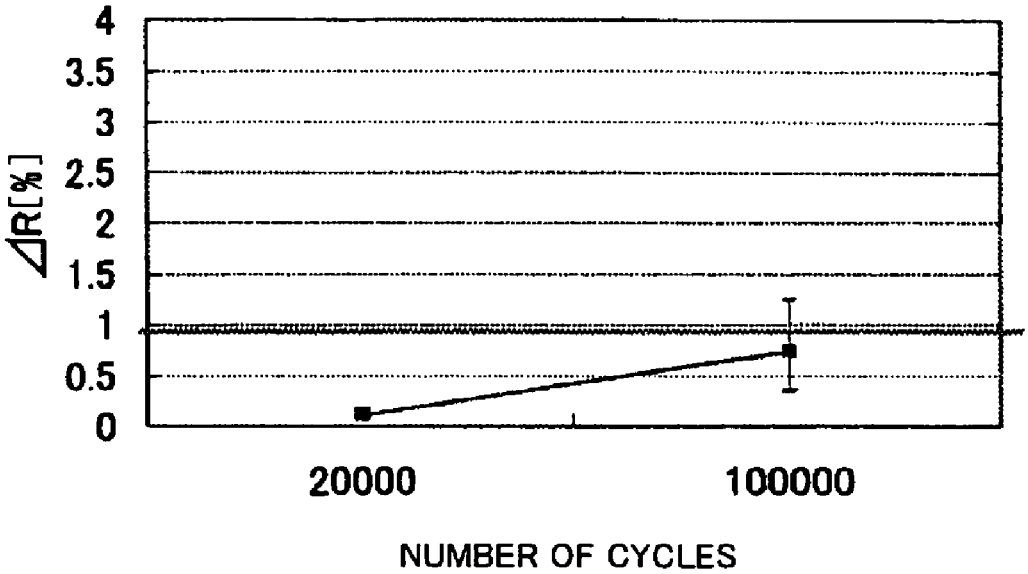
FIG. 8B is a graph showing the results of a power cycle test conducted on an I-shaped resistor according to a comparative example.

FIGS. 8A and 8B show the results of a power cycle test conducted on the H-shaped resistor and the conventional I-shaped resistor that are mounted on an aluminum board. The H-shaped resistor is a resistor of the above structure which has a resistance of 1 mΩ, and the conventional I-shaped resistor is a resistor of the structure in which the flat resistive body shown in FIG. 3A has electrodes of the same width on its opposite ends, the resistor having a resistance of 1 mΩ. The resistive bodies of the H-shaped resistor and the I-shaped resistor have the same dimensions and are made of the same material. The H-shaped resistor and the I-shaped resistor are different from each other as to the electrode structure including the resistive body of the electrode sections and the electrodes.

The power cycle test was conducted by repeating, 100,000 times, a cycle of turning on the applied electric power of 12 W for six seconds and turning it off for six seconds. After the 100,000 cycles, the rate ΔR of change of the resistance of the H-shaped resistor fell within 1% as shown in FIG. 8A, and the rate ΔR of change of the resistance of the I-shaped resistor exceeded 1% as shown in FIG. 8B. It is thus possible to keep the rate ΔR of change of the resistance of the resistor mounted on the aluminum board within 1% by employing the electrode sections which are octagonal in shape as viewed in plan that are progressively wider than the main section. The rate ΔR of change of the resistance is calculated by the following equation:

$$\Delta R(\%)=((R_1-R_0)/R_0)\times 100$$

where $R_0$: the resistance measured before the test, $R_1$: the resistance measured after the test.

Figure 9A:
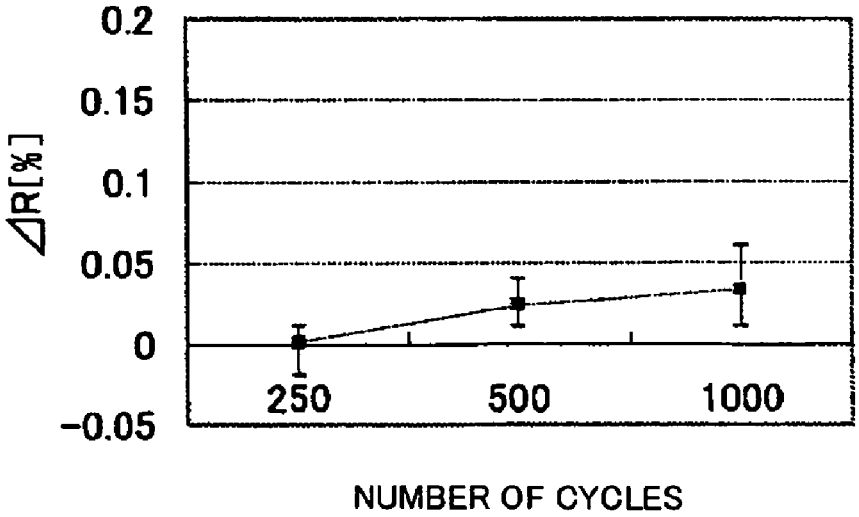
FIG. 9A is a graph showing the results of a heat cycle test conducted on an H-shaped resistor.
Figure 9B:
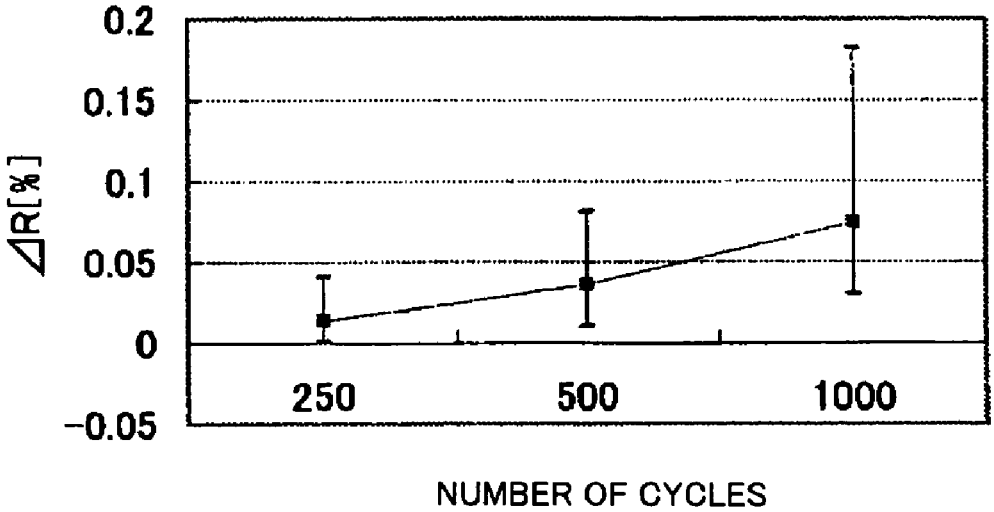
FIG. 9B is a graph showing the results of a heat cycle test conducted on an I-shaped resistor according to a comparative example.

FIGS. 9A and 9B show the results of a heat cycle test conducted on the H-shaped resistor and the conventional I-shaped resistor that are mounted on an aluminum board. The heat cycle test was conducted by repeating, 1,000 times, a cycle of keeping the resistor at a high temperature of 125° C. for 30 minutes and at a low temperature of −40° C. for 30 minutes. The rate ΔR of change of the resistance, as shown in FIG. 9A, of the H-shaped resistor with the electrode sections which are octagonal in shape as viewed in plan that are progressively wider than the main section was smaller than the rate ΔR of change of the resistance, as shown in FIG. 9B, of the I-shaped resistor. As the number of cycles, represented by the horizontal axis, increases, the range (absolute value thereof) of the rate ΔR of change of the resistance progressively increases. The range of the rate ΔR of change of the resistance of the H-shaped resistor is smaller than that of the I-shaped resistor. Specifically, in 750 cycles from the 250th cycle to the 1,000th cycles, the range of the rate ΔR of change of the resistance of the I-shaped resistor is about 5.3 times greater than the range of the rate ΔR of change of the resistance of the H-shaped resistor.

In these tests, the rate ΔR of change of the resistance is considered to increase because of minute cracks developed in the soldered joints due to thermal fatigue, forming small resistances in the soldered joints. The above results of the test indicate that the H-shaped resistor with the electrode sections which are octagonal in shape as viewed in plan that are progressively wider than the main section suffers essentially no thermal fatigue developed in the soldered joints even when the H-shaped resistor is mounted on an aluminum board whose coefficient of linear expansion is widely different from that of the metal plate resistor. Therefore, even when the metal plate resistor is mounted on a mounting board such as an aluminum board or the like whose coefficient of linear expansion is widely different from that of the metal plate resistor, good results can be obtained from thermal cycle tests such as a power cycle test and a heat cycle test. The metal plate resistor can thus be mounted on an aluminum board without causing any significant problems.

The results of an analysis of the thickness of the electrodes of the metal plate resistor will be described below. When the metal plate resistor is in operation, a large current flows from one of the land patterns on the mounting board into one of the electrodes, then flows through one of the resistive body of the electrode sections into the main section, and then flows through the other electrode section into the other electrode, from which the current flows into the other land pattern. The electrodes which are made of a highly conductive metal conductor are required to develop a uniform potential distribution therein. Specifically, though the land patterns and the electrodes are joined by the soldered joints, the joined state of the soldered joints may not necessarily be uniform, but may differ from mounted state to mounted state. If the soldered joints between the land patterns and the electrodes cause variations of the measured resistance, then a high resistance accuracy in terms of an allowable resistance error of ±1% cannot be achieved. It is thus desired to provide a uniform potential distribution in the electrodes without being affected by the soldered joints between the land patterns and the electrodes.

Figure 10:
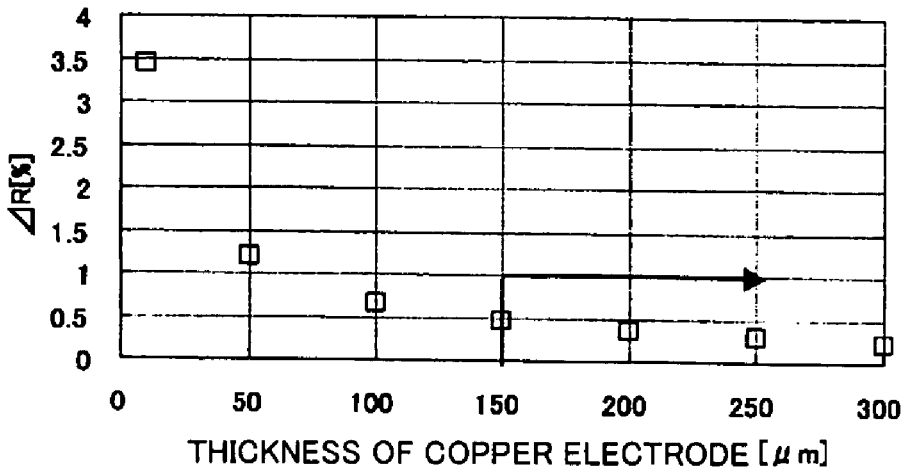
FIG. 10 is a graph showing the results of a simulation of the relationship between electrode thicknesses and rates ΔR of change of measured resistance.

Precision resistors having an allowable resistance variation range of ±1% are required to have a uniform potential distribution in the electrodes. If the copper electrodes are too thin, then they fail to provide a sufficiently uniform potential distribution in the electrodes. FIG. 10 shows the results of a simulation of the relationship between electrode thicknesses and rates ΔR of change of measured resistance. It has been found that the copper electrodes of the H-shaped resistor having a resistance of 1 mΩ are required to have a thickness of at least 150 μm in order to reduce the rate ΔR of change of the resistance to 0.5% or less. The rate ΔR of change of the resistance is calculated by the following equation:

$$\Delta R(\%)=((R_1-R_0)/R_0)\times 100$$

where $R_0$: the resistance measured before the test, $R_1$: the resistance measured after the test.

The range of variations of the rate ΔR of change of the resistance is progressively smaller as the thickness of the copper electrodes increases as shown in FIG. 10.

The copper electrodes should be as thick as possible, but pose the following problems if too thick. Increasing the thickness $t_c$ of the copper electrodes directly results in an increase in the thickness $t_2$ of the entire resistor (see FIG. 7C). The thickness $t_c$ of the copper electrodes should be limited in view of demands for low-profile resistors. The thickness $t_c$ of the copper electrodes should preferably be at least 150 μm.

Figure 11:
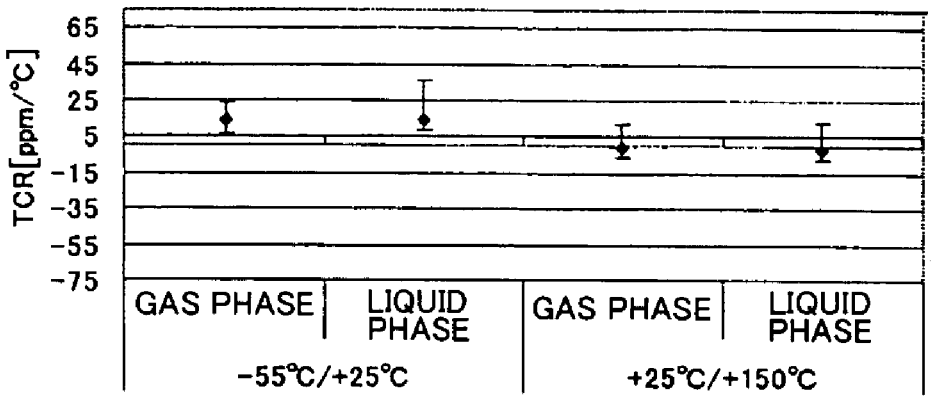
FIG. 11 is a graph showing measured values of temperature coefficients of resistance (TCR) of H-shaped resistors.

The thickness $t_c$ of the electrodes of the H-shaped resistor is 200 μm, for example. FIG. 11 shows showing measured values of temperature coefficients of resistance (TCR) of H-shaped resistors. The measured values shown in FIG. 11 indicate that the temperature coefficients of resistance (TCR), including variations, fall within a range of ±40 ppm/° C. Since the temperature coefficient of resistance (TCR) of the resistive body material is about ±20 ppm/° C., the resistor as a whole has a good temperature coefficient of resistance (TCR) without being affected by the high temperature coefficient of resistance (TCR) of copper.

Specifically, since the electrode sections of the H-shaped resistor are octagonal in shape as viewed in plan and progressively wider than the main section and the copper electrodes having a thickness of 200 μm are disposed beneath the resistive body of the electrode sections, a contribution of the high temperature coefficient of resistance (TCR) of copper is reduced, and a temperature coefficient of resistance (TCR) which is close to the temperature coefficient of resistance (TCR) of the resistive body material is achieved.

In the embodiment shown in FIGS. 6A and 6B, the electrode sections are octagonal in shape as viewed in plan. However, the beveled corners of the octagonal electrode sections may be replaced with curved or round corners for the same advantages as those of the beveled corners.

Although certain preferred embodiments of the present invention have been shown and described in detail, it should be understood that various changes and modifications may be made therein without departing from the scope of the appended claims.

What is claimed is:

1. A metal plate resistor comprising:

a resistive body comprising a metal plate; and at least a pair of electrodes joined respectively to opposite ends of said resistive body, said electrodes being made of a highly conductive metal conductor, wherein each of the portions of the resistive body joined to the electrodes has four beveled corners.

2. A metal plate resistor comprising:

a resistive body comprising a metal plate; and at least a pair of electrodes joined respectively to opposite ends of said resistive body, said electrodes being made of a highly conductive metal conductor, wherein the portions of the resistive body joined to the electrodes have curved corners.

3. A metal plate resistor comprising:

a resistive body comprising a metal plate; and at least a pair of electrodes joined respectively to opposite ends of said resistive body, said electrodes being made of a highly conductive metal conductor;

wherein said resistive body comprises a main section positioned between said electrodes and a pair of electrode sections progressively wider than said main section in directions away from said main section; and said electrodes are disposed respectively beneath said resistive body of said electrode sections and identical in shape to said resistive body of said electrode sections, wherein said electrodes are of an octagonal shape.

4. A metal plate resistor comprising:

a resistive body comprising a metal plate; and at least a pair of electrodes joined respectively to opposite ends of said resistive body, said electrodes being made of a highly conductive metal conductor;

wherein said resistive body comprises a main section positioned between said electrodes and a pair of electrode sections progressively wider than said main section in directions away from said main section; and said electrodes are disposed respectively beneath said resistive body of said electrode sections and identical in shape to said resistive body of said electrode sections, wherein said electrodes have a thickness of more than 150 μm.

5. A metal plate resistor comprising:

a resistive body comprising a metal plate;

at least a pair of electrodes joined respectively to opposite ends of said resistive body, said electrodes being made of a highly conductive metal conductor;

wherein said resistive body comprises a main section and a pair of electrode sections progressively wider than said main section in directions away from said main section, each of said electrode sections being of an octagonal shape as viewed in plan, and having an upper surface lying flush with an upper surface of said main section and a lower surface projecting downwardly beyond a lower surface of said main section; and said electrodes are of an octagonal shape as viewed in plan which is identical to the electrode sections and are joined respectively to the lower surfaces of said electrode sections;

a protective coating providing an integral covering on the upper surface of said main section, portions of the upper surfaces of said electrode sections, the lower surface of said main section, and side surfaces of said main section; and a plated coating providing an integral covering on lower surfaces of said electrodes, side surfaces of said electrodes, side surfaces of said electrode sections, and portions of the upper surfaces of said electrode sections which are not covered with said protective coating.

* * * * *